United States Patent [19]

Winson

[11] 4,343,753

[45] Aug. 10, 1982

[54] METHOD FOR FINISHING A TUBULAR FELTED SLEEVE

[75] Inventor: Michael A. Winson, Bury, England

[73] Assignee: Webron Products Limited, Rossendale, England

[21] Appl. No.: 198,314

[22] Filed: Oct. 20, 1980

Related U.S. Application Data

[63] Continuation-in-part of Ser. No. 20,700, Mar. 15, 1979, abandoned.

[30] Foreign Application Priority Data

Dec. 24, 1977 [GB] United Kingdom ..... 53910/77

[51] Int. Cl.[3] ..... D04H 5/00

[52] U.S. Cl. ..... 264/119; 264/110

[58] Field of Search ..... 264/119, 126, 234, 310, 264/319, 320, 323, 324, 345

[56] References Cited

U.S. PATENT DOCUMENTS 2,632,921 3/1953 Kreidl ..... 264/345
3,009,209 11/1961 Weinbrenner et al. ..... 264/310
3,192,294 6/1965 Streed et al. ..... 264/126
3,508,307 4/1970 Dilo ..... 28/4
4,071,394 1/1978 Ball ..... 28/110

FOREIGN PATENT DOCUMENTS 1380387 1/1975 United Kingdom .

*Primary Examiner*—James R. Hall
*Attorney, Agent, or Firm*—Alan H. Levine

[57] ABSTRACT

A method is disclosed for use in the finishing of sleeves (23) made by needle felting thermoplastics fibres. The sleeves (23) are placed over cylindrical supports (13) mounted for rotation about their axes and movable with a base such as a table (11) in a treatment path past heating means (17) where the outer fibres are heated to above their softening temperature to undergo at least partial melting. Simultaneously the sleeves (23) shrink generally onto the supports (13) which are identical, thus ensuring that all sleeves (23) treated have the same final inside diameter. If desired, the sleeves (23) after heating can be moved past and in pressure-loaded contact with a smooth surface (20) to give them a glazed or calendered outer surface.

4 Claims, 2 Drawing Figures

METHOD FOR FINISHING A TUBULAR FELTED SLEEVE

Figure 1:
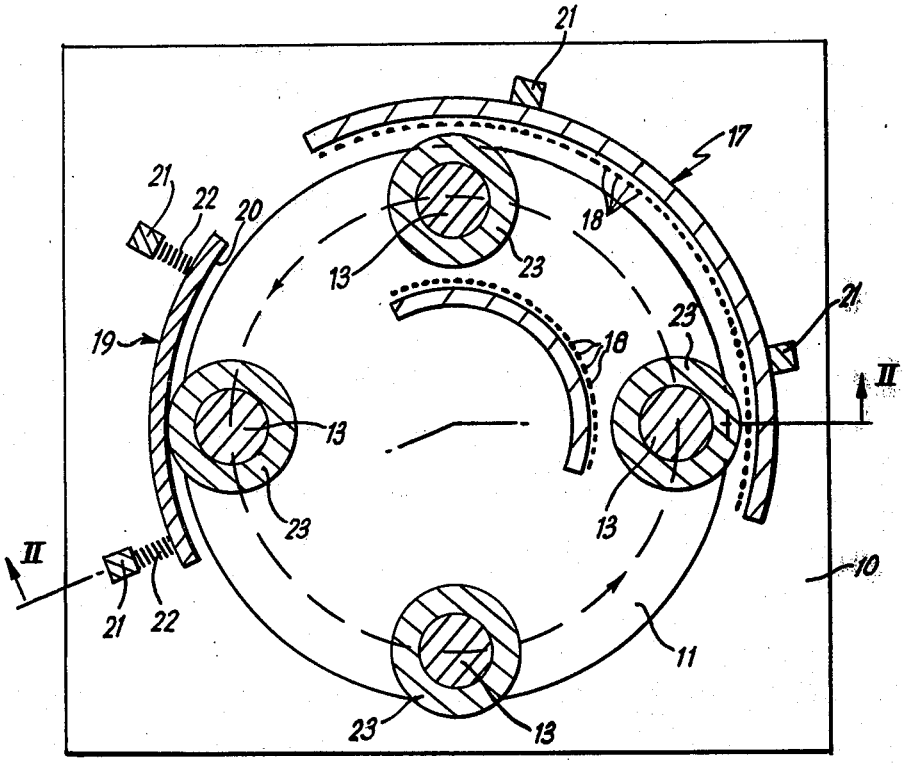

This is a continuation-in-part application of application Ser. No. 020,700, filed Mar. 15, 1979, now abandoned.

This invention relates to a method of finishing a tubular felted sleeve. The sleeve can be for use as a support for yarn to be dyed (a "dyeing sleeve") or for use in filtration (a "filter sleeve").

A needle-felted sleeve can be produced as described in U.S. Pat. Nos. 3,508,307 and 3,758,926. Sleeves so produced are used for many purposes, for example as roller coverings, as dyeing sleeves, for cutting up into gaskets, and as filter elements. However, when used as dyeing sleeves and filter elements they have the disadvantage that their surface finish is too fibrous in that it exhibits too many random fibres and is "busty;" this means that when used as a dyeing sleeve thin yarns tend to become entangled and attached to the sleeve, which results in waste and expenditure of time in cleaning the sleeve for re-use. In filtering, cake can adhere to the rough fibrous surface, which requires extra work to dislodge it and the possibility of loss of cake.

Normal, flat webs of felt can have their surfaces modified quite easily by singeing, i.e. heating, or by singeing and subsequently calendering the surface. This is very easy to do with a material in the form of a web; the web can be simply passed over or under a heater and, if desired, through calendar rolls. This cannot be done with tubes, because if they were passed between calendar rolls they would heat set in a flattened condition and give poor subsequent performance. Also, being tubular, they would shrink, to an unknown and variable degree and thus not at all be suitable for use where a fixed diameter sleeve is required. This is particularly important in relation to dyeing and filter sleeves.

Thus, the problem underlying the invention is to provide a method of applying a singed or singed and calendered surface to a needle-felted tubular sleeve without distorting it and, importantly, without allowing it to shrink in diameter.

Surprisingly, we have found that we can achieve these ends by particularly simple means.

According to the invention there is provided a method of finishing a needle-felted tubular sleeve comprising placing the sleeve over a cylindrical support mounted for rotation relative to a base, rotating the support and sleeve while moving the base to cause the sleeve to pass a heat source and have its outside surface uniformly heated by the heat source to cause partial melting of the outer fibres of its outside surface, allowing the sleeve to cool and removing it from the support.

The method of the invention has two important effects. Firstly, the heating and partial melting of the fibres on the outer surface of the tube at least partially destroys the "fluffy" nature of the surface and makes the sleeves suitable for use as a dyeing sleeve for coarse and medium yarns. Secondly, although of great importance the constraining of the tube on a cylindrical support while it is heated means that the tube can only shrink to the diameter of the support. As this diameter is fixed and conforms to a desired use diameter of the sleeve, the sleeve after finishing is exactly the correct size internally. In practice the support will be one of a plurality of identically sized supports on the base, and thus as a plurality of tubes are finished, they will all have the same final inside diameter, even if there had been some variations in the original diameters due to previous manufacturing variations.

The method can further include the step of progressing the rotating support past a smooth surface to calender the outer surface of the tube.

Heating is preferably carried out by radiant heaters, for example electric heating elements.

Conveniently, the base is a rotatable circular table and the supports upstand therefrom. Alternatively, the base can be a movable endless carrier chain or conveyor.

The heating means can be a tunnel oven lined with radiant electric heating elements and the glazing or calendering surface can be a part-cylindrical plate coaxial with the table. The plate can be spring-loaded towards the table and coated with P.T.F.E. or other non-stick compound.

Figure 2:
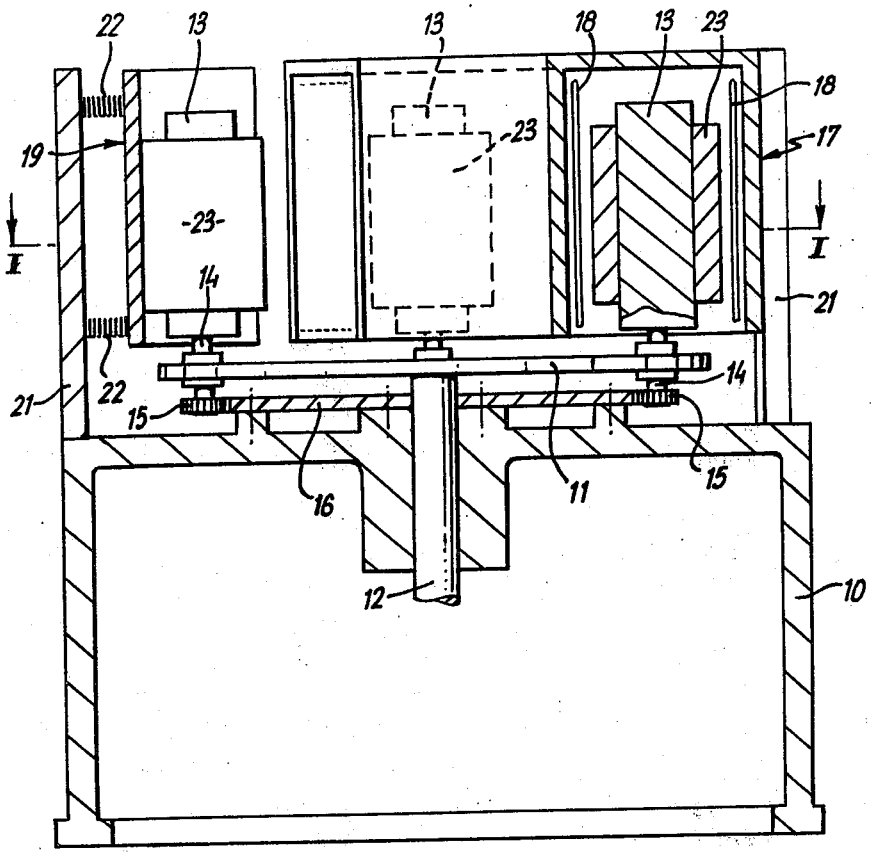

The invention will be described further, by way of example, with reference to the accompanying drawings, wherein:

FIG. 1 is a horizontal cross-section of apparatus for carrying out the invention taken on line I—I of FIG. 2; and FIG. 2 is a vertical cross-section through the apparatus of FIG. 1 taken on the line II—II of FIG. 1.

A preferred apparatus for performing the method of the invention is mounted on a frame 10 which supports a base in the form of a horizontal circular table 11 rotatable about a vertical axis by means of a shaft 12 and an associated gearing or belt drive (not shown). Around its periphery the table 11 mounts four identical upright cylindrical supports 13. Each support 13 has a stub axle 14 journalled in table 11 and carrying, beneath the table 11, a pinion 15 engaging a gear wheel 16 co-axial with the table 11 and fixed to frame 10. Thus, as table 11 rotates, the supports 13 rotate about their own vertical axes.

Heating means is provided in the form of a tunnel oven 17 of inverted U-section, having insulating walling lined with radiant electric heating elements 18. Downstream of the oven 17 is a part-cylindrical plate 19, co-axial with and extending circumferentially of the table 11, whose inner surface 20 constitutes a glazing-/calendering surface and is coated with a non-stick material such as P.T.F.E. The oven 17 and plate 19 are supported on posts 21 upstanding from the frame, plate 19 being spring loaded by compression springs 22.

The apparatus shown in the drawings is a prototype. A normal production machine will probably have a table of greater extent and a substantially greater number of supports. It should be further noted that the thickness of the sleeves 23 shown in the drawings is somewhat exaggerated.

In operation an operator or appropriate automatic means (not shown) positioned adjacent the lower edge (in FIG. 1) of the frame 10 places sleeves 23 on support 13 as they pass him or it. Each sleeve 23 is heated on passage through oven 17 so that its outer fibres are heated to at least 30° C. above the softening point of the fibres, which are of thermoplastics material. The sleeve then passes plate 19 and is caused to engage its smooth inner surface 20 which applies a calendered finish by compressing the partially-melted fibres and adhering them to the body of the sleeve. Rotation of the sleeves ensures that the entire outer surface of each is uniformly treated. The sleeves now pass back to the lowermost position in FIG. 1 whereat they are removed from the supports 13 and replaced by untreated sleeves.

If an outer surface which is "singed" but not calendered is required, the plate 19 can be removed or withdrawn from the path of travel.

At the removal position the sleeves 23 have cooled sufficiently to be handled and also are too cool to shrink. This is important, because the heating of the sleeves does cause general overall shrinkage of the sleeves, which shrinking is limited by the size of the supports 13. Thus all the sleeves treated have the same final diameter irrespective of any variations in original diameter due to variations in manufacturing conditions. As the sleeves usually have to be eventually used in position on a cylindrical tube or mandrel, e.g. as dyeing sleeves or filter sleeves, this careful control of the final inside diameter is most beneficial.

The invention is not limited to the precise details of the foregoing and variations can be made thereto. For example, the base can be a chain or similar conveyor-like body and rotation of the supports can be achieved by means of a separate chain or by a belt and pulley arrangement. The heating means could be operated by hot air or means other than electric radiant heaters.

The actual surface finish, for example the degree of singe or the type of calendered surface obtained can be varied within wide limits by varying the degree of heating. This can be varied by adjusting the temperature of the individual heating elements, by adjusting the position of the heating elements relative to the sleeves' or by varying the speed at which the sleeves pass the heating means. Sleeves of different diameters can be treated by providing supports of different sizes.

Many other variations are possible within the scope of the following claims.

I claim:

1. A method of finishing a needle-felted tubular sleeve having exposed outer fibres, comprising placing the sleeve over a cylindrical support mounted for rotation relative to a base, rotating the support and sleeve while moving the base to cause the sleeve to pass a heat source and have its outside surface uniformly heated by the heat source to cause partial melting of the outer fibres of its outside surface, allowing the sleeve to cool, and removing it from the support.

2. A method as claimed in claim 1, wherein the support is one of a plurality of identically-sized supports on the base, and the sleeve is one of a plurality of sleeves being finished sequentially.

3. A method as claimed in claim 1, further including the step of progressing the rotating support past a smooth surface while the heated sleeve contacts the smooth surface, and before cooling the sleeve, to calender the outer surface of the sleeve.

4. A method as claimed in claims 1, 2 or 3, wherein heating is carried out by radiant heaters, for example electric heating elements.

* * * * *